United States Patent [19]

Müller et al.

[11] Patent Number: 4,641,940

[45] Date of Patent: Feb. 10, 1987

[54] SHEET FILM PROCESSING APPARATUS FOR EXPOSED SHEET FILM

[75] Inventors: Jürgen Müller; Alfons Kastl; Heinrich Färber, all of Munich, Fed. Rep. of Germany

[73] Assignee: Agfa-Gevaert AG, Leverkusen, Fed. Rep. of Germany

[21] Appl. No.: 765,873

[22] Filed: Aug. 14, 1985

[30] Foreign Application Priority Data

Aug. 31, 1984 [DE] Fed. Rep. of Germany ..... 3432077

[51] Int. Cl.[4] ..... G03D 3/08

[52] U.S. Cl. ..... 354/322; 354/324

[58] Field of Search ..... 354/319, 320, 321, 322, 354/324, 312, 316

[56] References Cited

U.S. PATENT DOCUMENTS 3,978,506 8/1976 Geyken et al. ..... 354/324
4,081,816 3/1978 Geyken et al. ..... 354/324
4,101,919 7/1978 Ammann ..... 354/319
4,187,023 5/1980 Schausberger et al. ..... 354/321

*Primary Examiner*—A. A. Mathews
*Attorney, Agent, or Firm*—Michael J. Striker

[57] ABSTRACT

A sheet film processing apparatus for sheet film including a housing for holding a re-loadable film, and having an upper surface and a back surface, developing equipment including developing tanks with developing fluid, arranged above the upper surface, a housing cover for covering the developing equipment in a light impervious manner, elements for leading the film to the developing device, a fluid collector basin located between the developing tank and the upper surface for catching any developing fluid which may fall from the developing equipment, a waste water tank provided at the back surface, and a plurality of drain hoses connecting the tanks and the collector basin with the waste water tank so as to lead the developing fluid to the waste water tank. This leads to a particularly compact construction which is easily accessible for servicing.

22 Claims, 4 Drawing Figures

SHEET FILM PROCESSING APPARATUS FOR EXPOSED SHEET FILM

BACKGROUND OF THE INVENTION

The invention relates to a sheet film processing apparatus in which the sheet film, either exposable or exposed sheet film, preferably X-ray film, is reloadable and is guidable thereto in a light impervious manner by means of transport rollers of a connected to developing apparatus.

Apparatuses of this type are for example known as loading and unloading apparatuses for X-ray film cassettes. Thereby, the single cassette of exposed X-ray film is either directly led through a light impermeable channel to a developing machine set up behind the apparatus, or is led into an intermediate holder from which it is transported to the developing machine. These known arrangements require a great deal of space and are therefore not well suited for smaller X-ray facilities.

Also, for example, are known photographing apparatuses in which a sheet film is brought into a film platform and exposed there and then transported into either an intermediate holder or a developing apparatus set up behind the photographing apparatus. An apparatus of this type to produce projection screen photographs is described in the older German Patent Application No. P 34 18 960.2-51. This also has the problem that the exposed film is transported in a light impervious intermediate holder and from there must be brought into a separate space consuming developing apparatus where still more working steps are additionally necessary.

SUMMARY OF THE INVENTION

It is an object of the present invention to provide an improved film processing apparatus of the previously mentioned type that have an X-ray film cassette loading apparatus or a photographing apparatus for picture screen or X-ray photographs. The improvement being that the exposed film can be developed in a particularly space saving manner without additional manipulations, and the risk of damage from overflowing or unsealed developing tanks is nevertheless reduced.

Pursuant to this object and others which will become apparent hereafter, one aspect of the invention resides in placing of developing tanks over an upper side of the apparatus which results in a particularly space saving, spatious arrangement. A collector basin is located below the developing tanks thereby avoiding damage to the apparatus because of pervious points or overflowing fluids of the developing apparatus. A waste water tank is also provided which makes possible emptying of the developing tanks and the collector basin in a most simple manner. Due to the movable and with the apparatus interlockable positioning of the water tank unwanted flowing away of the same is avoided, on one hand, on the other hand, it is hereby possible to move the waste water tank to a drain line for waste water and to empty it there, or to move to the waste water tank so far backward so that the back side of the apparatus which is constructed as a lid can be opened for repair purposes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
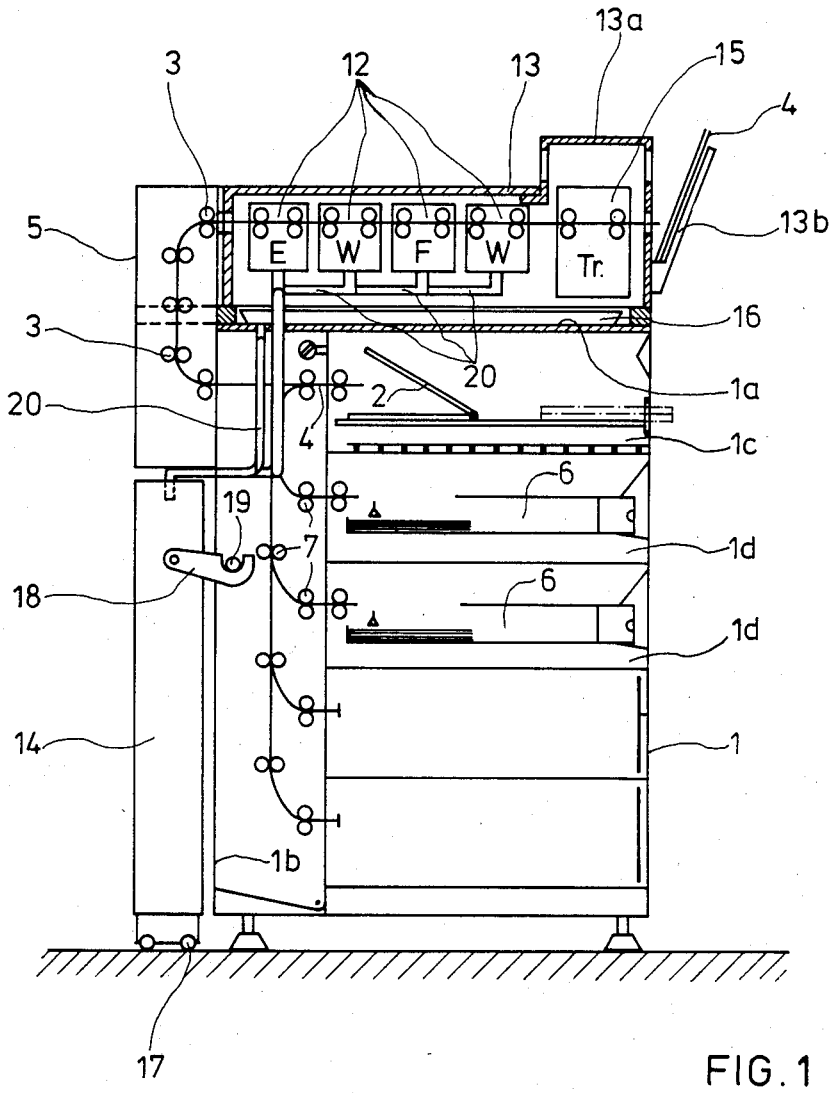
FIG. 1 is a sectional side view of a cassette loading apparatus pursuant to the present invention.
Figure 2:
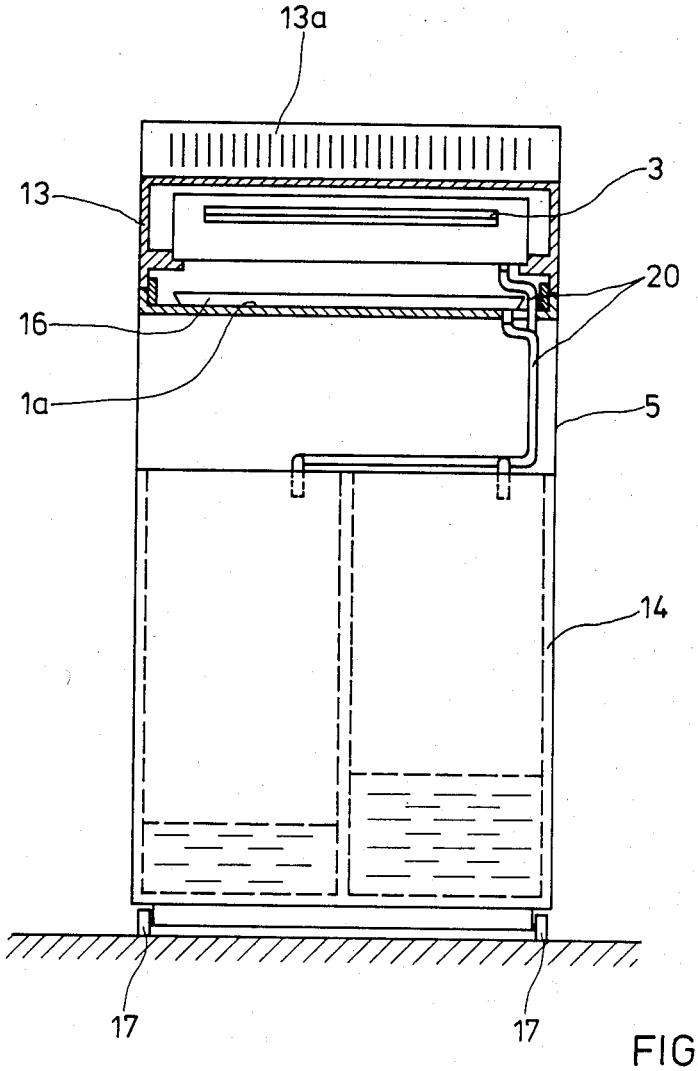
FIG. 2 is an end view of the apparatus of FIG. 1.
Figure 3:
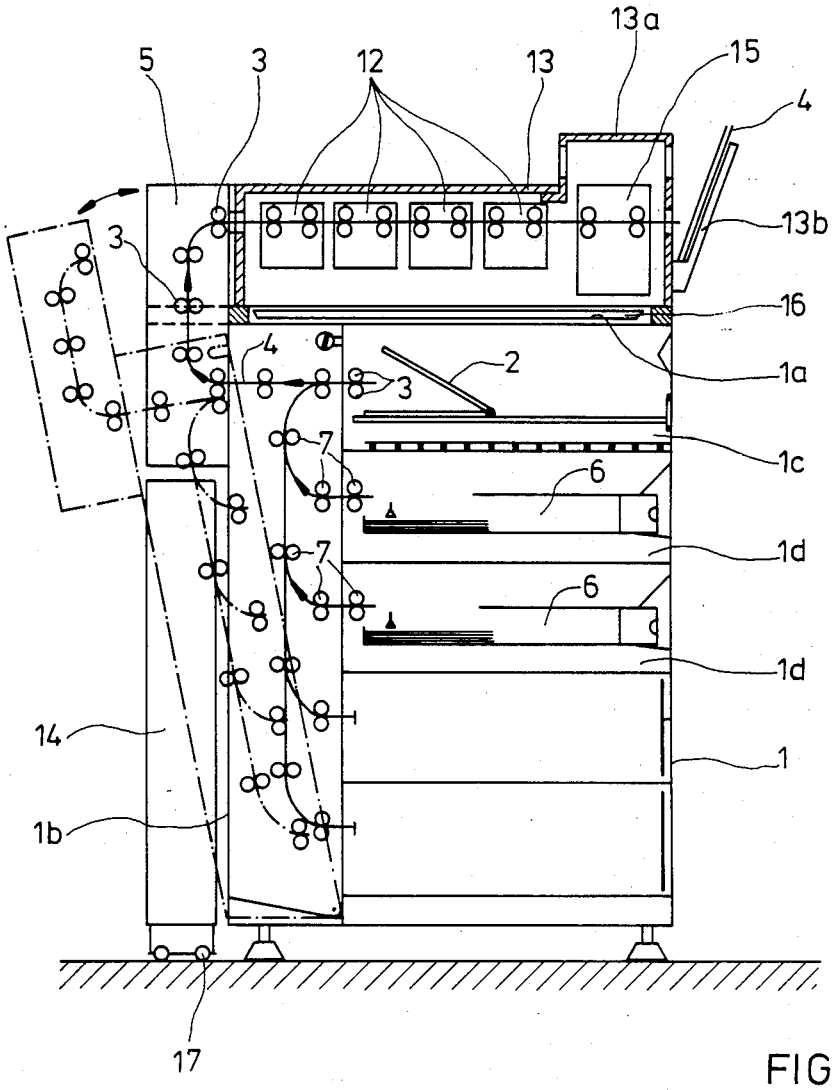
FIG. 3 is a view similar to FIG. 1, with dashed lines showing a setting for repair.

In FIGS. 1 through 4, a known apparatus in which exposed sheet film is present in a known manner, is indicated with the number 1. The apparatus has a somewhat customary upper side 1*a* and a back side 1*b*. In FIGS. 1 through 3, the apparatus 1 is a known X-ray film cassette loading and unloading apparatus, wherein an X-ray film cassette 2 is movable into an uppermost slide-in unit 1*c* and is automatically openable in a light impervious area. By means of known transport roller pairs, indicated in general with the number 3, which lead an exposed film 4, located in the opened cassette 2, over a not illustrated vacuum, the exposed film 4 is transported out of the cassette slide-in unit 1*c* into a further housing part 5 projecting above the upper side 1*a* and the back side 1*b*. Below the slide-in unit 1*c* are located further slide-in units 1*d* for so-called dispenser magazines 6. In these slide-in units 1*d*, magazines 6 for various film formats are inserted. In known and therefore not illustrated and described manners, the cassette format is automatically determined and after emptying of a cassette 2, undeveloped film of a corresponding format is taken from a corresponding dispenser magazine 6 and guided into the cassette 2, the latter is then closed and again transported out of the slide-in unit 1*c*. Transport roller pairs 7 are provided for this purpose.

Figure 4:
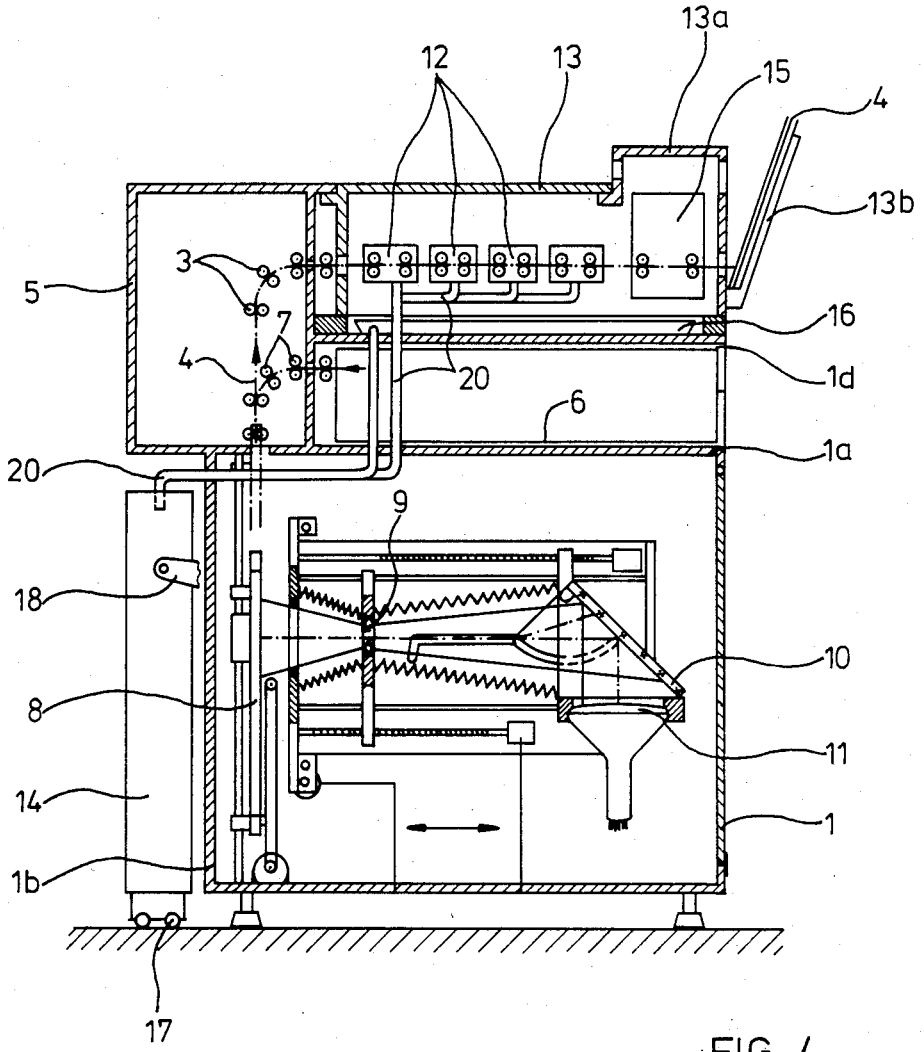
FIG. 4 is a schematic sectional side view of a picture screen photographing apparatus pursuant to the present invention.

The apparatus 1 as illustrated in FIG. 4 is a projection screen photographing apparatus provided with a film platform 8, an adjustable lens 9, a surface mirror 10 and a projection screen 11 which is to be photographed, together with other mechanical and electrical means. Unexposed film is transported by customary transport means out of a dispenser magazine 6 in a slide-in unit 1*d*, through the transport rollers 7 and into the film platform 8 and is exposed there. After exposure, the film is transported out of the film platform 8 by means of the transport roller pairs 3 into the additional housing part 5.

Corresponding parts of the two apparatuses 1 are indicated in FIGS. 1 through 3 or 4 with the same reference number, so as not to read on the type of equipment referred to in the invention under discussion. It is only essential that after the functional completion of the exposed film 4 corresponding to the apparatus, it is on hand in the apparatus for developing in a space saving manner without processing handling. The additional housing part 5 is itself comparatively small, compared with the apparatus 1, and extends only so much upwardly over the upper surface 1*a* and toward the back over the back surface 1*b*, as the height of developing tanks or fixing and washing tanks 12 and their housing cover 13 as well as the depth necessary for an optimum measured waste water tank 14. A drying chamber 15 can be connected to the tank 12 in the area of the front side of the apparatus, and the corresponding housing portion 13*a* can be raised and provided with ventillation slots. The raised housing portion 13*a* is provided on the front side of the apparatus with a collector tray 13*b* for the developed and dried films 4. The housing cover 13, which covers the tanks 12 for a complete developing apparatus, fits securely between the upper surface 1*a* of the apparatus 1 and the further housing part 5, and completes the apparatus 1 into a compact final apparatus which processes or produces an exposed sheet film 4 and develops the same. In order to prevent damage to the apparatus 1 or the film dispenser magazine 6 from developing fluids which are inadvertently spilled while filling the tanks 12 or appear over time from unsealed locations, a collector basin 16 is provided immediately above the upper surface 1*a* of the apparatus 1. The dimensions of the collector basin 16 are provided so that the width and length extend so as to provide a required surface area which reaches under the tanks 12 and into the drip area of the drying chamber 15, so that all drops of, or overflowing, fluids fall into the basin 16.

The waste water tank 14 is supported on wheels 17 and is so dimensioned that it is slidable under the additional housing part 5 and onto the back surface 1*b*. By means of a detachable latch mechanism 18, 19, the waste water tank 14 can be latched to the back wall 1*b* in a working position. The waste water tank 14 can be provided with a plurality of compartments so that different fluids in the tanks 12 can each be separated in the waste water tank 14 for further use or for removal. In a not illustrated manner, the waste water tank 14 can be provided with a drain for discharge of the waste water, or if necessary the waste water can also be pumped out.

A flexible discharge hose 20 runs from each individual tank 12 and the collector basin 16 inside the housings 13, 1 and laterally next to the transport rollers 3 and the slide-in units 1*c*, 1*d*, to the waste water tank 14 for the compartments therein. Naturally, the discharge hoses 20 of the tanks 12 must be closeable by hand-operable valves, which are not illustrated in the drawing.

As seen in FIG. 3, the back surface 1*b* of the apparatus 1 and the additional housing part 5 are formed as one or two box-like covers in which the transport rollers 3 or 7 are turnably and driveably provided. This has the advantage that by disruptions or repairs, the transport unit is rearwardly pivotable into a position as shown in FIG. 3 by the dashed lines, so that the slide-in units 1*c*, 1*d* are accessible. In addition to this, it is merely necessary to loosen the latch mechanism 18, 19 and to move back the waste water tank 14. Therefore, in spite of the compactness, the resulting apparatus offers comfortable serviceability. In a similar manner, the photographing apparatus of FIG. 4 can also be provided with a flat tiltable back cover so as to allow access to the film platform 8 to correct any disruptions.

While the invention has been illustrated and described as embodied in a sheet film pocessing apparatus for exposed sheet film, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Sheet film processing apparatus for sheet film, comprising:

means for processing the sheet film, and having an upper side and a back side;

means for developing the sheet film including a plurality of developing tanks holding fluid, located above said processing means;

means for transporting the sheet film from said processing means to said developing means;

a fluid collector basin located between said developing tanks and said upper side of said processing means, said collector basin being provided so as to catch any fluid which may fall from said developing means;

a waste water tank provided at said back side of said processing means; and means for connecting said developing tanks and said collector basin with said waste water tank so as to lead said fluid to said waste water tank.

2. Apparatus as defined in claim 1, wherein said connecting means includes a plurality of drain hoses.

3. Apparatus as defined in claim 2; and further comparing a housing having a housing cover which covers said developing means in a light impervious manner.

4. An apparatus as defined in claim 1, wherein said developing means further includes a drying chamber.

5. An apparatus as defined in claim 1, wherein said transport means includes transport roller pairs.

6. An apparatus as defined in claim 3; and further comprising means for closing said drain hoses which are connected to said developing tanks, said closing means being accessible from outside said housing.

7. An apparatus as defined in claim 6, wherein said closing means includes valve means.

8. An apparatus as defined in claim 3; and further comprising an additional housing part which houses a part of said transport means, said additional housing part being located above said upper side and said back side of said processing means so as to provide a first space between said upper side and said additional housing part and a second space between said back side and said additional housing part, said housing cover being located in said first space, and said waste water tank being located in said second space.

9. An apparatus as defined in claim 2, wherein said processing means includes an upper wall located on said upper side, and a back wall located on said back side, said plurality of drain hoses running through said upper wall, laterally next to said transport means, through said back wall and into said waste water tank.

10. An apparatus as defined in claim 8; and further comprising means for moving said waste water tank so that it is movable into and out of said second space.

11. An apparatus as defined in claim 10, wherein said moving means includes wheels.

12. An apparatus as defined in claim 10; and further comprising means for releasably holding said waste water tank to said housing.

13. An apparatus as defined in claim 12, wherein said holding means includes a releasable stop mechanism.

14. An apparatus as defined in claim 12, wherein said holding means includes a latch device.

15. An apparatus as defined in claim 12, wherein said additional housing part has a back side, at least one of said back sides being formed as a hinged cover.

16. An apparatus as defined in claim 12, wherein both said back sides are formed as a hinged cover.

17. An apparatus as defined in claim 16, wherein said hinged cover is formed as a hood in which a corresponding portion of the transport means is located so as to be pivotable away from said housing.

18. An apparatus as defined in claim 16, wherein said hinged cover is formed as a shell in which a corresponding portion of said transport means is located so as to be pivotable away from said housing.

19. An apparatus as defined in claim 15, wherein a portion of said transporting means is located in said covers of both said back sides.

20. An apparatus as defined in claim 15, wherein said holding means is provided between said waste water tank and said hinged cover.

21. An apparatus as defined in claim 2, wherein said waste water tank is provided with a plurality of chambers for holding various fluids, said plurality of drain hoses connecting each of said developing tanks to a corresponding chamber of said waste water tank.

22. An apparatus as defined in claim 1; and further comprising means for draining said waste water tank.

* * * * *